US006166642A

United States Patent [19]

Farshid

[11] Patent Number: 6,166,642

[45] Date of Patent: Dec. 26, 2000

[54] ELECTRONIC TRACING SYSTEM

[76] Inventor: Koopal Farshid, Flat A, 22 Beryl Road, Hammersmith, London W68JT, United Kingdom

[21] Appl. No.: 09/481,658

[22] Filed: Jan. 11, 2000

[51] Int. Cl.[7] ..... G08B 23/00

[52] U.S. Cl. ..... 340/573.1; 340/539; 340/574; 455/421; 455/420; 455/410; 455/429

[58] Field of Search ..... 340/573.1, 539, 340/574; 116/214; 455/421, 420, 88, 410, 411, 69, 229

[56] References Cited

U.S. PATENT DOCUMENTS

| | | | |
|---|---|---|---|
| 4,598,272 | 7/1986 | Cox | 340/539 |
| 4,758,826 | 7/1988 | Wall | 340/691 |
| 5,638,044 | 6/1997 | Chua | 340/426 |
| 5,661,460 | 8/1997 | Sallen et al. | 340/573 |
| 5,708,421 | 1/1998 | Boyd | 340/573 |
| 5,841,352 | 11/1998 | Prakash | 340/573 |
| 5,905,461 | 5/1999 | Neher | 342/357 |

*Primary Examiner*—Jeffery A. Hofsass
*Assistant Examiner*—Tai T. Nguyen
*Attorney, Agent, or Firm*—St. Onge Steward Johnston & Reens LLC

[57] ABSTRACT

An electronic tracing system 10 is provided for sensing when a child moves more than a predetermined distance from a guardian. The system comprises a first module 20 for attaching to the child and a second module 30 which is carried by the guardian. The first module is adapted alternately to broadcast location signals and change to a receiving mode between the broadcasts. The second module is adapted to detect the location signals and includes means 200 for processing the location signals to determine whether the distance apart of the modules exceeds the predetermined distance. If the predetermined distance is exceeded then a buzzer 140 is activated and an LED 150 flashes to inform the guardian of this. The guardian can then press a push button switch 160 on the second module to transmit an alarm signal to the first module so as to cause a connected smoke canister 105 to emit smoke.

14 Claims, 4 Drawing Sheets

ELECTRONIC TRACING SYSTEM

FIELD OF THE INVENTION

The present invention relates to an electronic tracing system for detecting when a movable subject moves more than a predetermined distance from a base location. It has application, for example, to the subject being a child or a mobile phone.

BACKGROUND OF THE INVENTION

Children at play often move away or out of sight of parents or other guardians having responsibility for them. At such times, it would be desirable for a guardian to know if a child has wandered more than a predetermined distance away as this may indicate that the child is lost or in trouble. It would also be desirable quickly to locate or trace that child.

Furthermore, when mobile phones are lost or stolen, it would be useful for the owner to know if the phone has been removed more than a predetermined distance from him. It would be desirable to be able to disable a lost or stolen mobile phone.

SUMMARY 0F THE INVENTION

According to the present invention there is provided an electronic tracing system for sensing when a movable subject moves more than a predetermined distance from a base location. The system includes a first module having attaching means for attaching the first module to the subject. The first module also comprises first transmitting means for broadcasting location signals, receiving means for receiving signals, and first processing means for adapting the first module to alternately broadcast location signals via the transmitting means and change to a receiving mode for receiving signals via the receiving means between the broadcasts. The system also includes a second module for disposing at the base location. The second module comprises detecting means for detecting the location signals and second processing means for processing the location signals to determine whether the distance apart of the modules exceeds the predetermined distance. If the second processing means determines that the distance apart of the modules exceeds the predetermined distance then the second processing means activates an alarm device and a second transmitting means is then operable to transmit an alarm signal from the second module to the first module.

The first module may be adapted to emit a sound or visual signal upon receipt of the alarm signal. Conveniently, upon receipt of the alarm signal, the first module activates a smoke canister to produce a visual signal.

The subject may be a child or other person. Optionally, if the subject is feeling threatened he can manually activate the first module to emit the sound or visual signal.

The subject may be a mobile phone or other electronic device, which the first module is adapted to disable upon receipt of the alarm signal.

It may be desirable for the second module to include a timer for measuring the time elapsed from when the alarm device is activated and cancelling means, where the second module transmits an alarm signal to the first module after a specified period of time has elapsed unless the cancelling means is activated before then.

DESCRIPTION OF THE PREFERRED EMBODIMENTS

Figure 1:
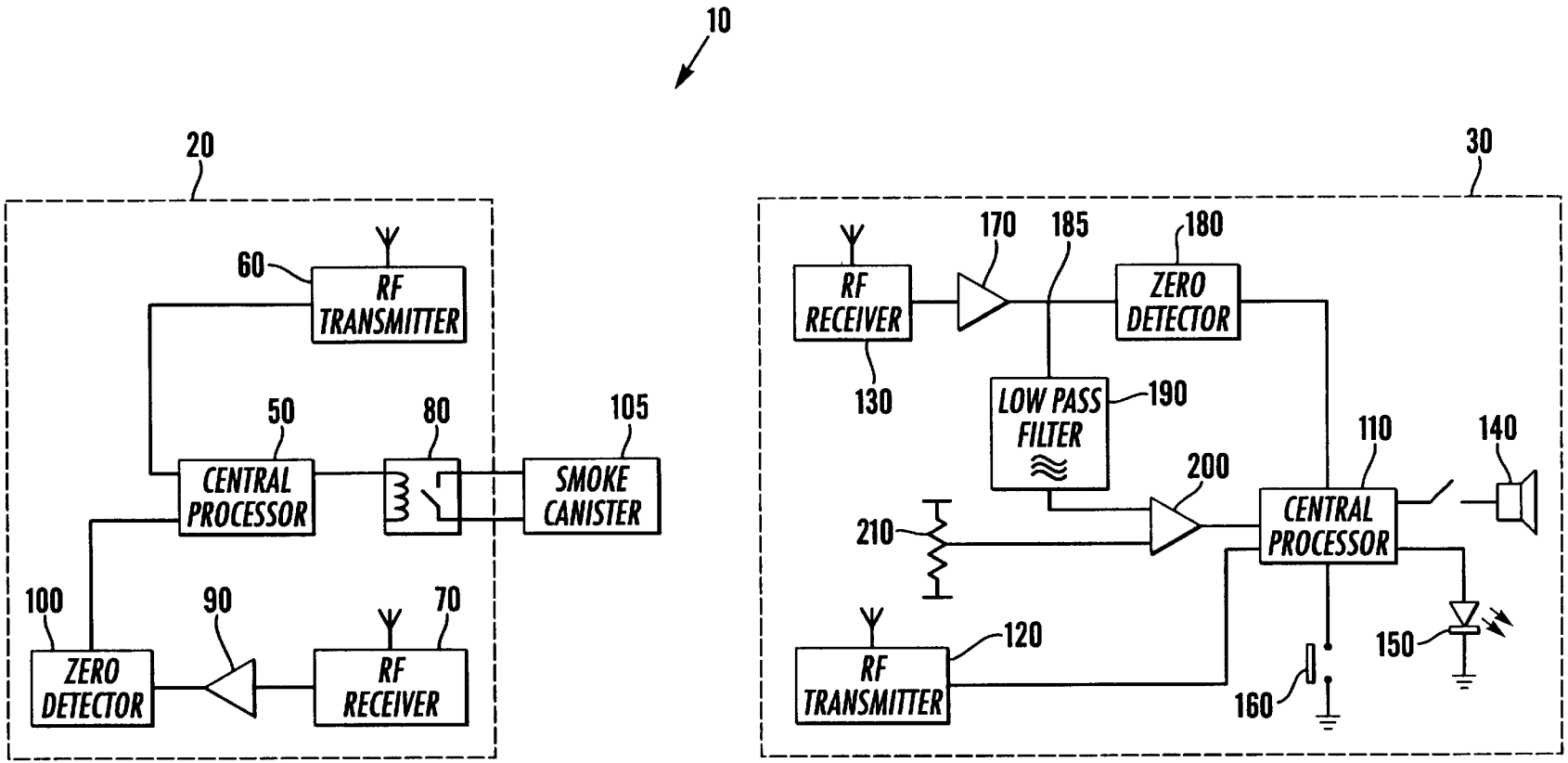
FIG. 1 is a schematic diagram of an electronic tracing system according to a first embodiment of the invention.
Figure 2:
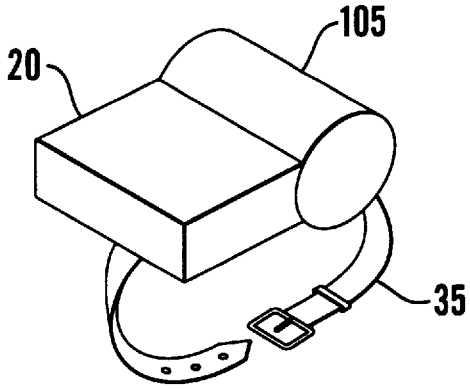
FIG. 2 is a perspective view of a first module of the system with an attached smoke canister.

In FIG. 1 of the accompanying drawings, the electronic tracing system 10 includes first and second modules 20,30 for respectively attaching to a movable subject and locating at a base station, the first module being attached to the subject by a strap 35 (see FIG. 2).

The first module 20 includes a central processor 50 to which are connected a radio frequency (RF) transmitter 60, an RF receiver 70 and a relay 80. The receiver is connected to the central processor via an AF amplifier 90 and a zero detector 100. A smoke canister 105 is attached to the first module and is connected to the central processor via the relay.

The second module 30 includes a central processor 110 to which are connected an RF transmitter 120, an RF receiver 130, alarm devices comprising an alarm buzzer 140 and a light emitting diode (LED) 150, and a push button switch 160. The RF receiver is connected to the processor via an AF amplifier 170 and a zero detector 180. The junction 185 between the AF amplifier and zero detector is also connected to the processor via a low pass filter 190 and a comparator 200 with the comparator being additionally connected to a reference resistor 210.

The circuit components of the two modules may be conventional. A suitable central processor 50,110 for each module 20,30 is a PIC 16C84 microprocessor.

In use, the first module 20 may, for example, be securely attached by the strap 35 to a playing child that the guardian is responsible for so that it can not be easily removed or fall off. A parent or guardian having responsibility for the child carries the second module 30 or locates it close by so that it is within hearing or sight.

When activated, the central processor 50 of the first module 20 of the electronic tracing system 10 alternates every 5 seconds between being in a broadcast mode and being in a receiving mode. In its broadcast mode, the central processor transmits a sequence of electromagnetic codes, via the RF transmitter 60, to the receiver 130 of the second module 30 and, in the receiving mode, the central processor of the first module awaits an alarm signal which is received, via the receiver 70, from the transmitter 120 of the second module 30.

The second module 30, upon receiving the codes detected by the receiver 130, amplifies them via the AF amplifier 170 and feeds them through the low pass filter 190. The comparator 200 compares the signal level of the codes against a threshold value stored in the reference resistor 210. The threshold value represents the level at which the signal should be when the first module 20 is at a distance of 50 metres from the second module in open space. If this comparison process determines that the level is below the threshold value, then the central processor 110 activates the alarm buzzer 140 and causes the LED 150 to flash in order to warn the guardian that the child is more than 50 metres away from him. The guardian is thus prompted to investigate where the child is. If the guardian thinks that the child is in danger he may then press the button on the second module to close the switch 160. This causes the second module to transmit an electromagnetic alarm signal, via the transmitter 120, to the receiver 70 of the first module. When the first module receives the alarm signal, the signal is amplified by the amplifier 90, is decoded and the central processor 50 actuates the relay 80 thereby causing the smoke canister 105 to emit smoke.

The smoke is coloured to produce a highly visible signal which signals to the public that the child, to whom the canister is attached, may be in difficulty. The smoke is non-toxic so that it can be safely released both indoors and outside and may comprise a fine powder.

Figure 3:
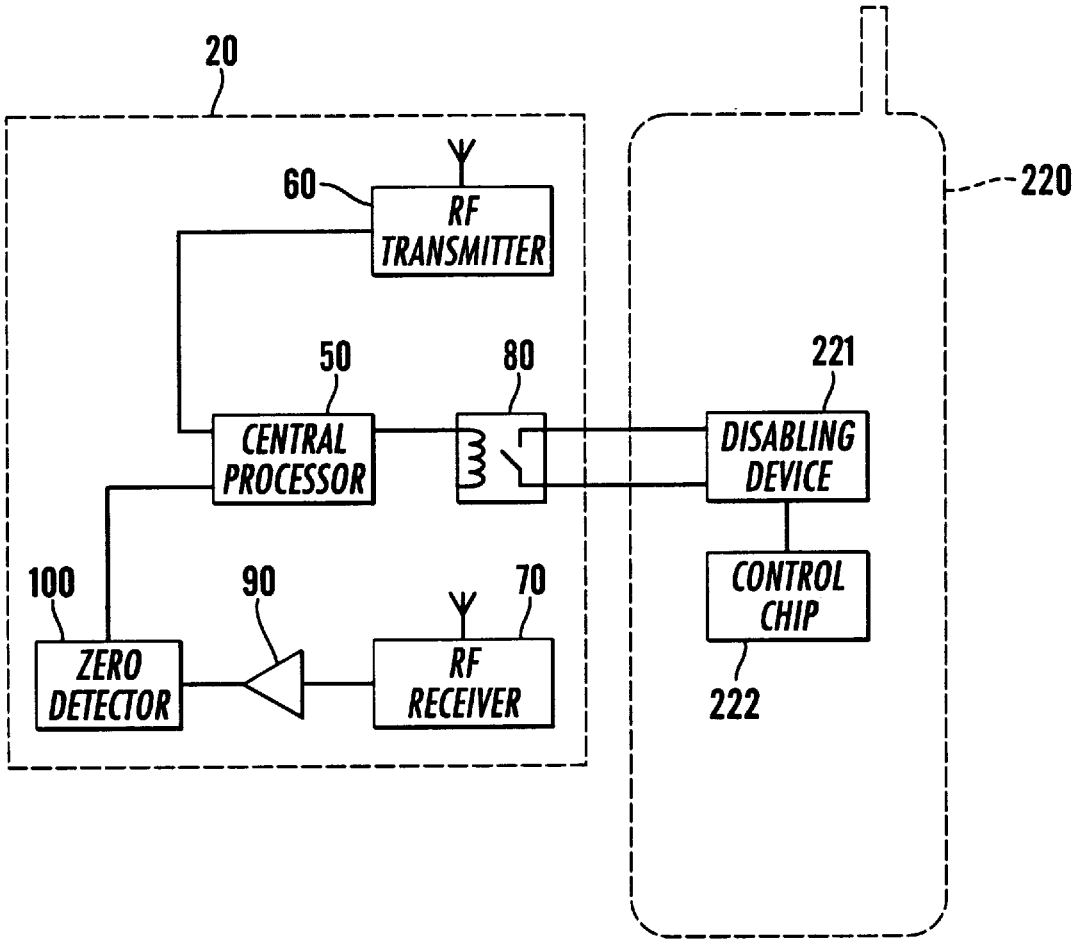
FIG. 3 is a schematic diagram of the first module connected to a mobile phone.

In a modification illustrated in FIG. 3, the first module 20 is connected to a mobile phone 220 and the smoke canister 105 is replaced by a device 221 that can disable the mobile phone. Otherwise the components are the same as those described in the first embodiment. The second module 30 is retained by the owner of the mobile phone.

In use, if the mobile phone 220 is more than 50 metres away from the owner, the alarm buzzer 140 is activated and the LED 150 flashes. This warns the owner to investigate where his mobile phone is. If the owner thinks that the mobile phone has been stolen, then he presses the button on the second module to actuate the relay 80 on the first module. This causes the mobile phone to be disabled, for example, by zapping the control chip 222 of the phone.

Figure 4:
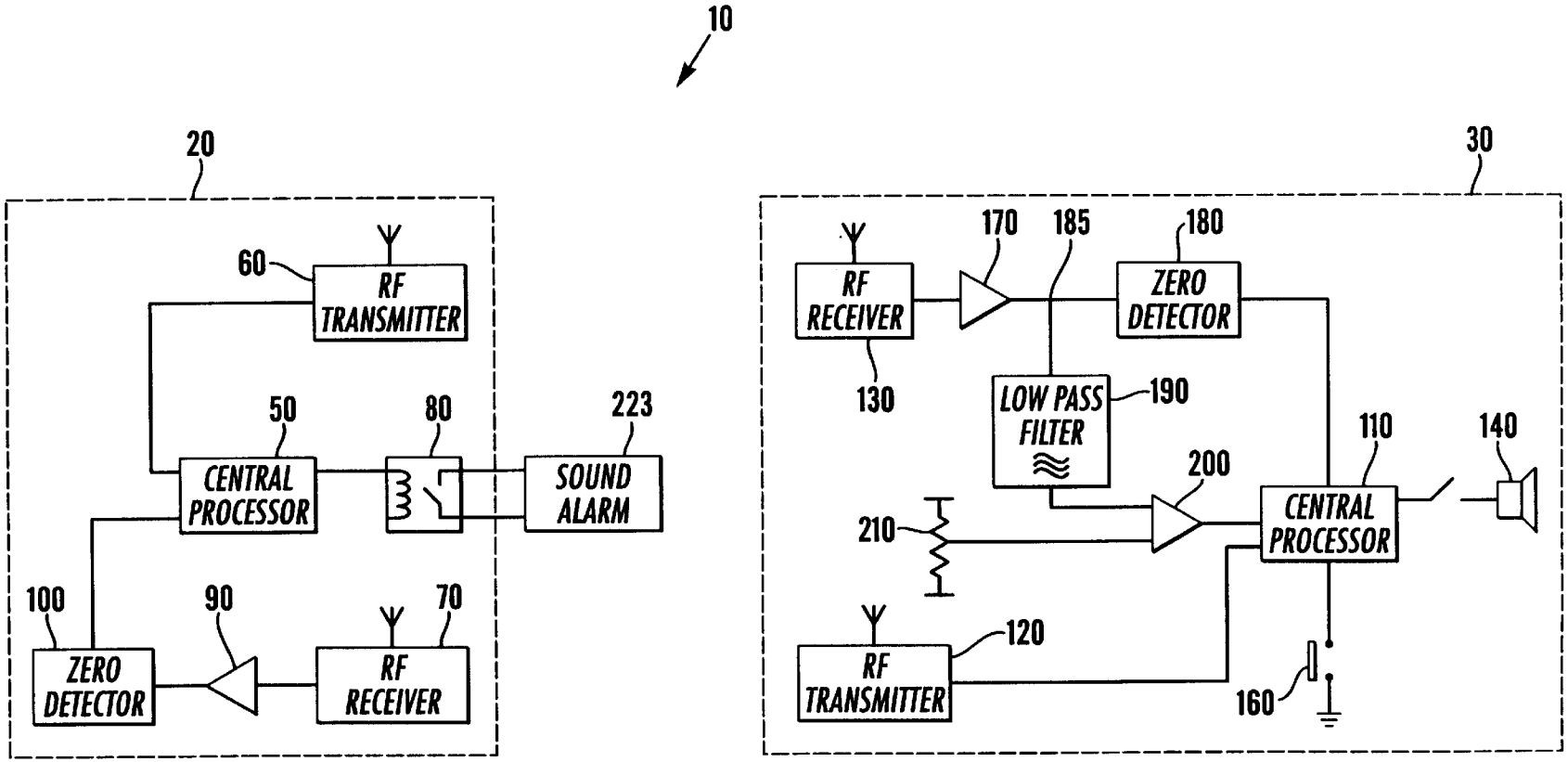
FIGS. 4 and 5 are schematic diagrams of modified electronic tracing systems.

Whilst particular embodiments have been described, it will be understood that various modifications may be made without departing from the scope of the invention. For example, a sound alarm 223 (see FIG. 4) could be activated by the relay 80 instead of a smoke canister 105. The LED 150 may be omitted. Although an alarm buzzer 140 has been shown in the described embodiment, any single or combination of devices may be used to indicate to the guardian or owner that the two modules 20,30 are more than the specified distance apart. A vibrator may be used for example. Also, the distance of 50 metres can easily be changed by having a different reference resistor 210 in the second module. The reference resistor may also be replaced by a variable resistor so that the distance can be easily adjusted by the user. Also, the length of time that the first module transmits a sequence of codes to the second module and the length of time that the first module awaits a reply can be adjusted.

Figure 5:
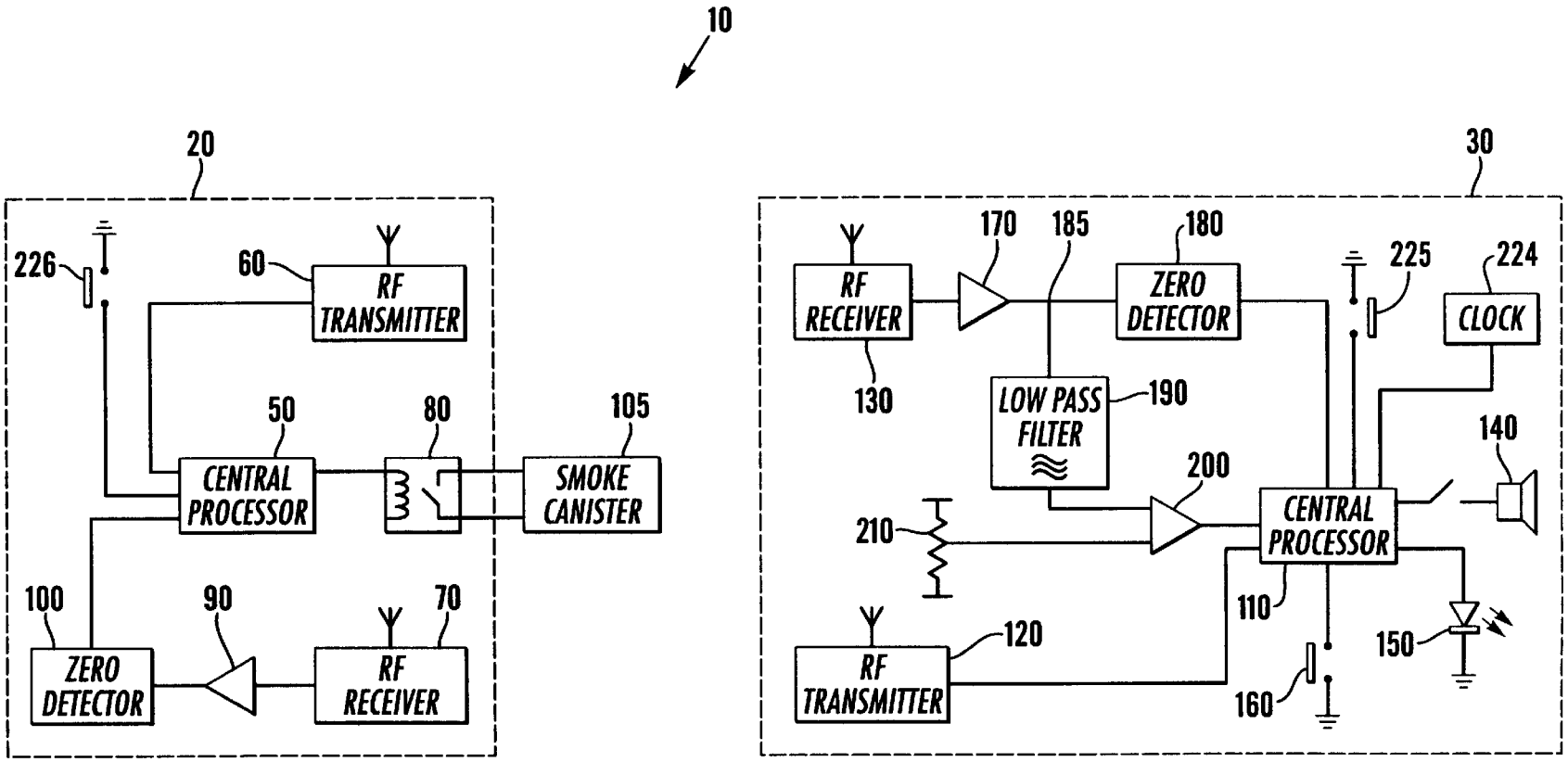

Referring to FIG. 5, the system 10 may also have a clock or timer 224 and a cancel button 225 connected to the central processor 110 of the second module 30. The clock is activated when the signal of the code received by the second module is less than the threshold value. When the clock reaches a specified time the smoke canister 105 in the first module is automatically activated unless the cancel button is pressed before then.

Optionally, the first module 20 may include a panic button 226 that a child can press to activate the smoke canister 105, if he or she is feeling lost or threatened.

What is claimed is:

1. An electronic tracing system for sensing when a movable subject moves more than a predetermined distance from a base location, said system comprising:

a first module, said first module including attaching means for attaching said first module to said movable subject, first processing means, first transmitting means and receiving means, said first processing means adapting said first module to alternately broadcast location signals from said first transmitting means and change to a receiving mode between said broadcasts; and a second module for disposing at said base location, said first and second modules being a distance apart, said second module including detecting means, second processing means, an alarm device, second transmitting means, a timer and cancelling means, wherein said detecting means being adapted to detect said location signals, said second processing means processing said location signals to determine whether said distance apart of said modules exceeds said predetermined distance, said second processing means activating said alarm device when said second processing means determines that said distance apart of said modules exceeds said predetermined distance and said timer is activated to measure said time, and said second transmitting means being operable to transmit an alarm signal to said first module upon activation of said alarm device said second transmitting means transmitting said alarm signal after a specified period of said time has elapsed unless said cancelling means is activated before then, said receiving means being adapted to receive said alarm signal.

2. The system as claimed in claim 1, wherein said second module includes activation means operable to activate said second transmitting means to transmit said alarm signal.

3. The system as claimed in claim 2, wherein said activation means is operable to activate said second transmitting means upon activation of said alarm device.

4. The system as claimed in claim 1, wherein said first module includes a visual signal emitter for emitting a visual signal upon receipt of said alarm signal.

5. The system as claimed in claim 4, wherein said visual signal emitter is a smoke canister.

6. The system as claimed in claim 1, wherein said first module includes a sound emitter for emitting a sound upon receipt of said alarm signal.

7. The system as claimed in claim 1, wherein said subject is a person.

8. The system as claimed in claim 7, wherein said subject is a child.

9. The system as claimed in claim 7, wherein said first module includes a visual signal emitter and second activation means for said subject to activate so that said visual signal emitter emits a visual signal.

10. The system as claimed in claim 7, wherein said first module includes a sound emitter and second activation means for said subject to activate so that said sound emitter emits a sound.

11. The system as claimed in claim 1, wherein said subject is an electronic device, which said first module is adapted to disable upon receipt of said alarm signal.

12. The system as claimed in claim 11, wherein said subject is a mobile phone.

13. An electronic tracing system for sensing when a movable subject moves more than a predetermined distance from a base location, said system comprising:

a first module, said first module including a strap for attaching said first module to said movable subject, a first processor, a first transmitter, a first amplifier, a first zero detector, a first receiver, said first receiver being connected to said first processor via said first amplifier and said first zero detector, a relay and a smoke canister connected to said first processor via said relay, said first processor adapting said first module to alternately broadcast location signals from said first transmitter and change to a receiving mode between said broadcasts; and a second module for disposing at said base location, said first and second modules being a distance apart, said second module including a second processor, a second receiver, a second amplifier, a junction, a second zero detector, a low pass filter, a comparator, a resistor storing a value representing said predetermined distance, an alarm buzzer, a light emitting diode, a switch and a second transmitter, wherein said second receiver being adapted to detect said location signals, said second receiver being connected to said second processor via said second amplifier, said junction and said second zero detector, said junction being additionally connected to said second processor via said low pass filter and said comparator, said comparator being connected to said resistor, said location signals having a level at said comparator, said comparator being adapted to compare said level of said location signals with said predetermined distance value stored in said resistor, said second processor determining from said comparator whether said distance apart of said modules exceeds said predetermined distance, whereupon said second processor activates said alarm buzzer and said light emitting diode and said second transmitting means being operable to transmit an alarm signal to said first receiver upon operation of said switch after activation of said alarm buzzer and said light emitting diode, whereupon said first processor activates said smoke canister to emit smoke after said first receiver receives said alarm signal.

14. An electronic tracing system for sensing when a movable subject moves more than a predetermined distance from a base location, said system comprising:

a first module, said first module including attaching means for attaching said first module to said movable subject, a first processor, a first transmitter, a first receiver, said first receiver being connected to said first processor, and a smoke canister connected to said first processor, said first processor adapting said first module to alternately broadcast location signals from said first transmitter and change to a receiving mode between said broadcasts; and a second module for disposing at said base location, said first and second modules being a distance apart, said second module including a second processor, a second receiver, a comparator, a resistor storing a value representing said predetermined distance, an alarm device, a switch and a second transmitter, wherein said second receiver being adapted to detect said location signals, said second receiver being connected to said second processor, said comparator being connected to said resistor, said location signals having a level at said comparator, said comparator being adapted to compare said level of said location signals with said predetermined distance value stored in said resistor, said second processor determining from said comparator whether said distance apart of said modules exceeds said predetermined distance, whereupon said second processor activates said alarm device and said second transmitting means being operable to transmit an alarm signal to said first receiver upon operation of said switch after activation of said alarm means whereupon said first processor activates said smoke canister to emit smoke after said first receiver receives said alarm signal.

* * * * *